US009874336B2

(12) United States Patent
Kotera et al.

(10) Patent No.: US 9,874,336 B2
(45) Date of Patent: Jan. 23, 2018

(54) LIGHT EMITTING MODULE AND ILLUMINATING DEVICE USING SAME

(71) Applicant: PANASONIC INTELLECTUAL PROPERTY MANAGEMENT CO., LTD., Osaka (JP)

(72) Inventors: Ryusuke Kotera, Osaka (JP); Osamu Tanahashi, Kyoto (JP); Akihiro Hirano, Shiga (JP); Hideharu Kawachi, Hyogo (JP); Yohei Hayashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 171 days.

(21) Appl. No.: 14/770,519

(22) PCT Filed: Feb. 21, 2014

(86) PCT No.: PCT/JP2014/000898
§ 371 (c)(1),
(2) Date: Aug. 26, 2015

(87) PCT Pub. No.: WO2014/132600
PCT Pub. Date: Sep. 4, 2014

(65) Prior Publication Data

US 2015/0377459 A1 Dec. 31, 2015

(30) Foreign Application Priority Data

Feb. 28, 2013 (JP) ..... 2013-039926
Jul. 12, 2013 (JP) ..... 2013-146845

(51) Int. Cl.
*F21V 21/00* (2006.01)
*F21V 19/04* (2006.01)
*F21V 19/00* (2006.01)

(52) U.S. Cl.
CPC ..... *F21V 19/04* (2013.01); *F21V 19/003* (2013.01)

(58) Field of Classification Search
CPC ..... F21V 19/04; F21V 19/003; F21V 19/045; F21V 15/015; F21V 15/04; F21V 15/01;
(Continued)

(56) References Cited

U.S. PATENT DOCUMENTS 2,951,611 A * 9/1960 Janness ..... F21S 8/02 16/362
6,293,510 B1 * 9/2001 Bradford ..... F21V 17/107 248/317

(Continued)

FOREIGN PATENT DOCUMENTS

JP 2008-251482 10/2008
JP 2009-54500 3/2009

(Continued)

OTHER PUBLICATIONS

U.S. Appl. No. 14/766,209 to Akihiro Hirano, filed Aug. 6, 2015.
Search Report issued by patent office in Patent Application No. PCT/JP2014/000898, dated May 13, 2014.

*Primary Examiner* — Elmito Breval
*Assistant Examiner* — Omar Rojas Cadima
(74) *Attorney, Agent, or Firm* — Greenblum & Bernstein, P.L.C.

(57) ABSTRACT

The light emitting module includes a light source unit and a base plate where the light source unit is detachably mounted. The light source unit has an installation mechanism for installation to the base plate, and the base plate has an installation mechanism counterpart engaged with the installation mechanism. In addition, the light emitting module has a hook mechanism that catches the light source unit and the base plate when the installation mechanism and the installation mechanism counterpart are not engaged with each (Continued)

other. The hook mechanism is contained within a thickness of the light source unit when the light source unit is mounted to the base plate. In this configuration, it is possible to prevent the light source unit from dropping from the base plate using the hook mechanism even when engagement between the installation mechanism and the installation mechanism counterpart is released.

20 Claims, 16 Drawing Sheets

(58) Field of Classification Search
CPC ..... F21V 14/025; F21V 21/02; F21V 21/002; F21V 21/35; F21V 23/06; F21V 23/009; F21V 17/00; F21V 17/002; F21V 17/107; F21V 17/162; F21V 17/164; F21V 1/143; F21Y 2105/006; F21W 2131/103; F21S 8/026; F21S 2/00; F21S 2/005
USPC ..... 362/368, 372, 374
See application file for complete search history.

(56) References Cited

U.S. PATENT DOCUMENTS

| | | | | |
|---|---|---|---|---|
| 8,066,412 | B2 * | 11/2011 | Vann | F21V 21/00 248/342 |
| 9,028,089 | B2 | 5/2015 | Kotera et al. | |
| 2011/0063832 | A1 | 3/2011 | Hu | |
| 2013/0279181 | A1 | 10/2013 | Kawachi et al. | |

FOREIGN PATENT DOCUMENTS

| | | |
|---|---|---|
| JP | 2012-174504 | 9/2012 |
| JP | 2012-186006 | 9/2012 |
| JP | 2012-199219 | 10/2012 |

* cited by examiner

Fig. 6A
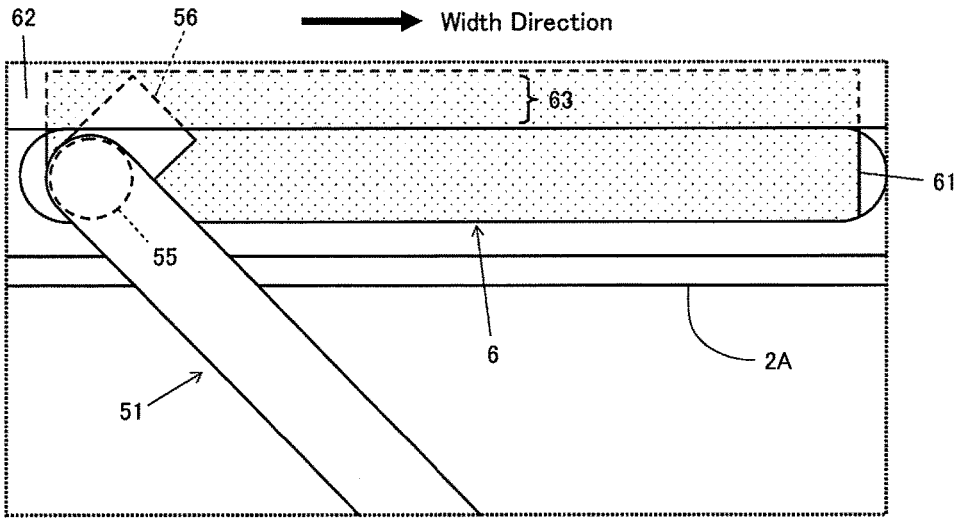
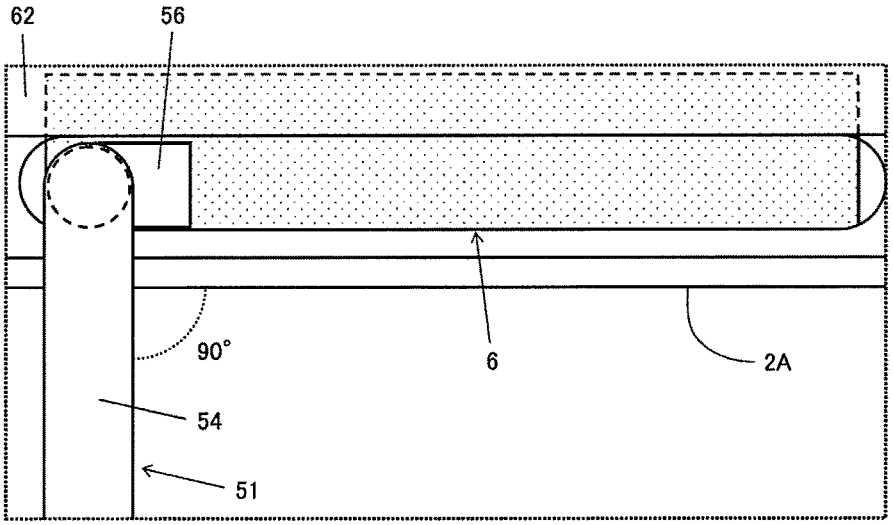
Fig. 6B

LIGHT EMITTING MODULE AND ILLUMINATING DEVICE USING SAME

TECHNICAL FIELD

The present invention relates to a light emitting module having an organic electroluminescent (EL) element as a light source and an illuminating device using the same.

BACKGROUND ART

Using an organic electroluminescent (EL) element, light can be emitted with high luminance at a low voltage, and various light colors can be obtained depending on types of organic compounds contained therein. In addition, a flat light emitting panel can be easily manufactured using the organic EL element. In recent years, development of a light emitting module having such an organic EL element as a light source is in progress.

There is known a light emitting module including a flat light source unit having an organic EL element, and a flat support mount (base plate) where the light source unit is detachably mounted (for example, see Patent Literature 1). One of the surfaces of the light source unit serves as a light emitting face, and the other surface (rear face) has a claw portion used in engagement with the base plate. Meanwhile, a holding portion engaged with the claw portion is provided on the mounting surface that faces the light source unit. The holding portion is biased by a biasing mechanism so as to slide in parallel to the mounting surface, and is engaged with the claw portion in the biased state. In such a light emitting module, since the claw portion is arranged in the rear side of the light source unit, the claw portion and the holding portion are concealed by the light source unit when the light source unit is mounted to the base plate. This is advantageous in a visual sense.

CITATION LIST

Patent Literatures

[Patent Literature 1] JP 2012-186006 A

SUMMARY OF INVENTION

However, in the light emitting module described above, a user needs to pull the light source unit resisting to a biasing force of the biasing mechanism when the light source unit is removed from the base plate. Therefore, a user may apply an excessive force so as to drop the light source unit from the base plate.

In view of the aforementioned problems, it is therefore an object of this invention to provide a light emitting module having a base plate where a light source unit is detachably mounted, capable of preventing dropping of the light source unit during removal of the light source unit from the base plate and providing a fancy look.

According to an aspect of the present invention, there is provided a light emitting module comprising: a flat light source unit; and a flat base plate having an electric feeding portion for feeding the light source unit with electric power, the light source unit having one surface as a luminescent face, the other surface opposite to the luminescent face having an installation mechanism for detachably installing the light source unit to the base plate, the base plate having an installation mechanism counterpart engaged with the installation mechanism on a mounting surface where the light source unit is mounted, the light emitting module further having a hook mechanism that catches the light source unit and the base plate when the installation mechanism and the installation mechanism counterpart are not engaged with each other, the hook mechanism being contained within a thickness of the light source unit when the light source unit is mounted to the base plate.

Preferably, the hook mechanism has a wire member provided in any one of the light source unit and the base plate, and a hook member provided in the other one and engaged with the wire member, and the wire member is pivotable against the light source unit or the base plate with respect to a portion matching an entangled portion entangled with the hook member.

Preferably, the wire member is slidable against the light source unit or the base plate.

Preferably, the light source unit has a concave portion that houses the wire member when the light source unit is mounted to the base plate.

Preferably, the installation mechanism is provided in both ends of the light source unit and has a holding portion and an engagement portion used in engagement with the installation mechanism counterpart, the holding portion is elastically biased reversely to a direction to the engagement portion, the installation mechanism counterpart has an engagement portion counterpart and a holding portion counterpart engaged with the engagement portion and the holding portion, respectively, the light source unit is pivotable toward the base plate while the engagement portion is engaged with the engagement portion counterpart of the base plate, and the wire member is engaged with the hook member when the light source unit is pivoted against the base plate.

Preferably, the wire member is separated from the hook member as the light source unit recedes from the base plate to separate the engagement portion from the engagement portion counterpart while the light source unit is pivoted against the base plate.

Preferably, the hook member is provided on the base plate and is arranged such that a leading end of the hook member faces the holding portion counterpart.

Preferably, the hook member is engaged with the wire member when the light source unit is pivoted reversely to a direction of mounting the light source unit to the base plate.

Preferably, the wire member has a curved portion where the hook member is fitted.

Preferably, the wire member has a stopper for restricting a pivoting range of the wire member.

Preferably, the wire member is detachably installed to the light source unit or the base plate in a position where pivoting is restricted by the stopper.

Preferably, the hook member has an erected piece erected from the mounting surface of the base plate, a paralleled piece extending from an end of the erected piece in parallel to the mounting surface, and a folded piece extending from an end of the paralleled piece toward a basal portion of the erected piece.

Preferably, a gap between an end of the folded piece and the mounting surface is smaller than a cross-sectional width of the wire member in an entangled portion entangled with the hook member, and is widened to be larger than the cross-sectional width as the hook member is elastically deformed.

Preferably, the hook member further has a locking piece extending from an end of the folded piece toward a connecting portion between the erected piece and the paralleled piece to lock the wire member, and a gap between an end of the locking piece and the mounting surface is larger than a cross-sectional width of the wire member in an entangled portion entangled with the hook member.

Preferably, the hook mechanism has an elastic member provided in any one of the light source unit and the base plate and a hook member provided in the other one and engaged with the elastic member.

Preferably, the hook mechanism has a foldable member provided in any one of the light source unit and the base plate and configured foldably, and a hook member provided in the other one and engaged with the foldable member.

According to another aspect of the present invention, there is provided an illuminating device comprising the light emitting module described above.

According to the present invention, a hook member is provided to catch the light source unit and the base plate when the installation mechanism and the installation mechanism counterpart are not engaged with each other. For this reason, even when a user disengages the installation mechanism and the installation mechanism counterpart from each other by pulling the light source unit in order to remove the light source unit from the base plate, the hook mechanism catches the light source unit and the base plate so that it is possible to prevent the light source unit from dropping from the base plate. In addition, since the hook mechanism is contained within a thickness of the light source unit when the light source unit is mounted to the base plate, it is possible to prevent an increase of the thickness of the light source unit and provide a fancy look of the light emitting module.

BRIEF DESCRIPTION OF DRAWINGS

FIG. 6A is an enlarged view illustrating a part enveloped by the dotted line of FIG. 5;

FIG. 6B is a diagram illustrating a state of the wire member pivoted against the light source unit from the state of FIG. 6A;

DESCRIPTION OF EMBODIMENTS

Figure 1:
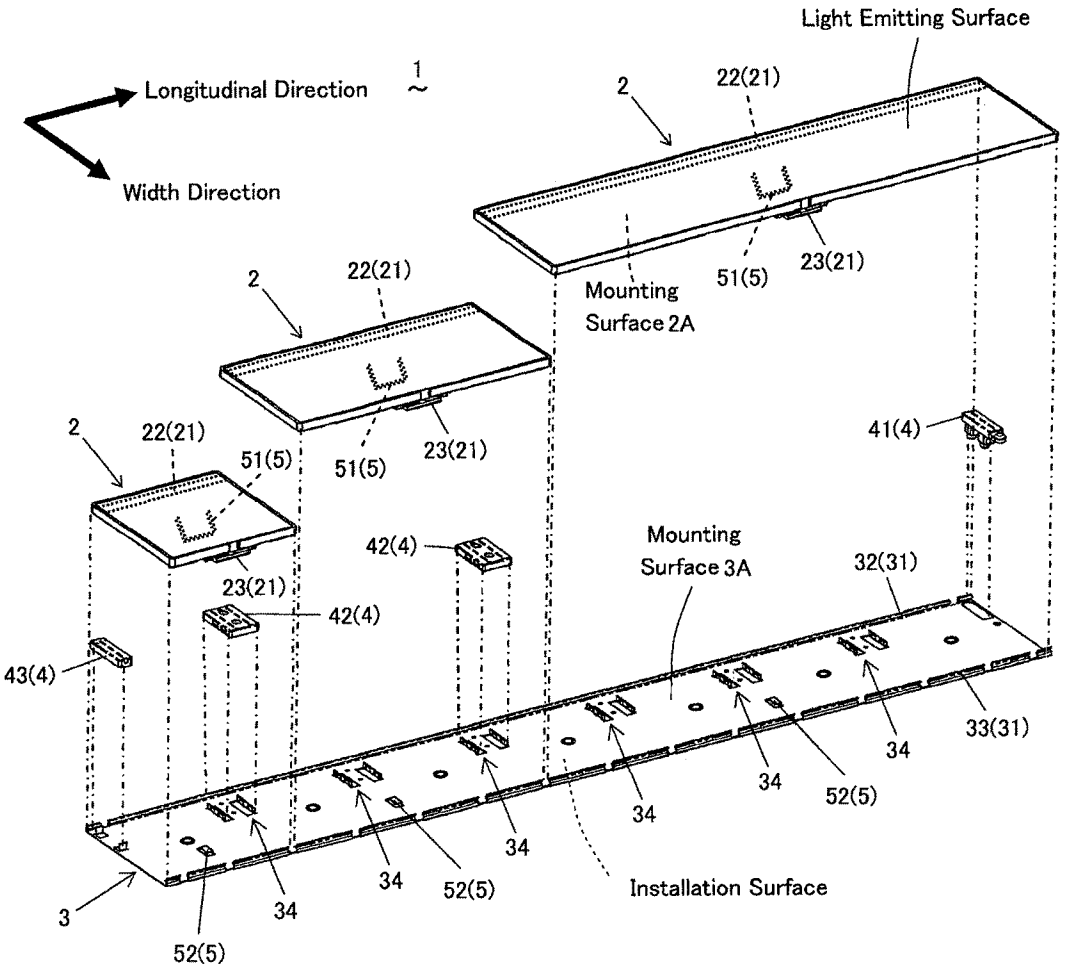
FIG. 1 is an exploded perspective view illustrating a light emitting module according to an embodiment of the present invention.
Figure 2:
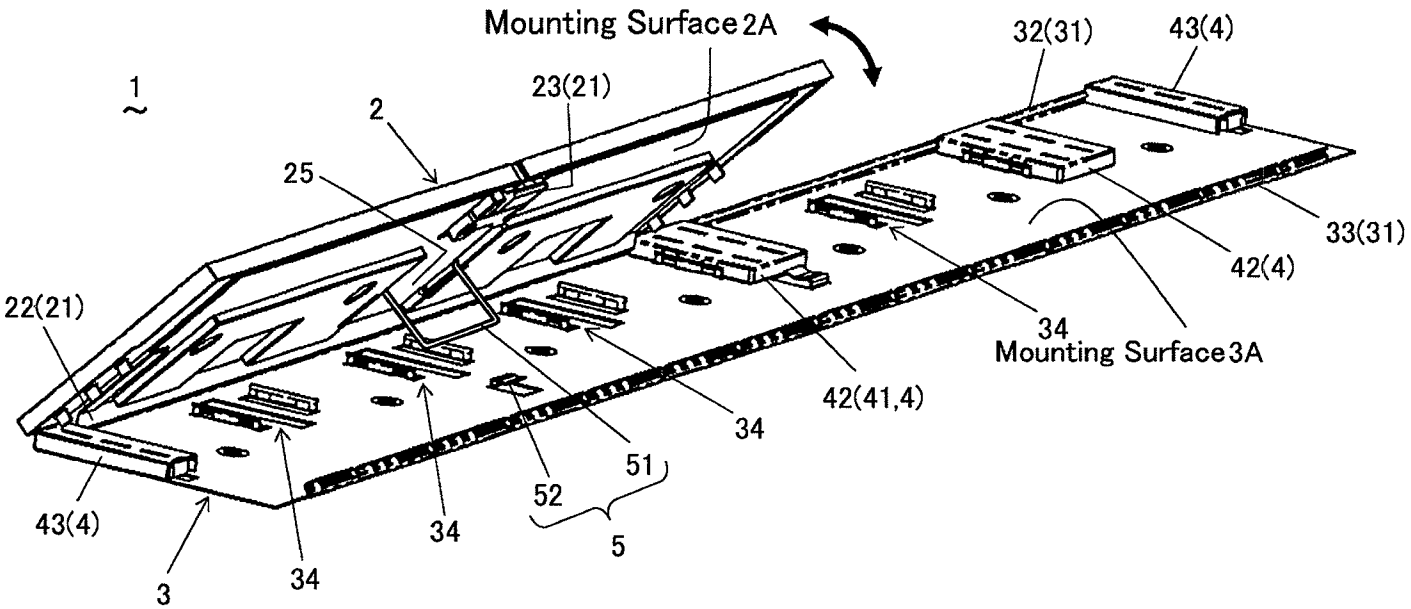
FIG. 2 is a perspective view illustrating a state of the light emitting module in which the light source unit is pivoted against the base plate.

A description will now be made for a light emitting module as an element of an illuminating device according to an embodiment of the present invention with reference to FIGS. 1 to 9. As illustrated in FIGS. 1 and 2, the light emitting module 1 comprises a rectangular flat light source unit 2 and a long rectangular flat base plate 3 where the light source unit 2 is mounted. In addition, the light emitting module 1 has an electric feeding portion 4 installed in the base plate 3 and used to feed the light source unit 2 with electric power, and a hook mechanism 5 for preventing the light source unit 2 from dropping from the base plate 3. It is noted that, in the following description, a length direction of the base plate 3 where the base plate 3 elongates will be referred to as a longitudinal direction, and a width direction of the base plate 3 perpendicular to this longitudinal direction will be referred to as a transverse direction.

One of the faces of the light source unit 2 serves as a mounting surface 2A mounted to the base plate 3, and the other face opposite to the mounting surface 2A serves as a luminescent face. The light source unit 2 has an installation mechanism 21 on the mounting surface 2A in order to allow for detachable installation to the base plate 3. The installation mechanism 21 has a holding portion 23 and an engagement portion 22 used in engagement with the base plate 3. The engagement portion 22 and the holding portion 23 are provided in both ends of the light source unit 2 in the transverse direction. The engagement portion 22 is provided across one side extending along the longitudinal direction of the light source unit 2, and the holding portion 23 is provided in the center of the other side extending along the longitudinal direction of the light source unit 2. The holding portion 23 is elastically biased by a spring 24 reversely to a direction to the engagement portion 22 (refer to FIG. 5).

One of the faces of the base plate 3 serves a mounting surface 3A for mounting the light source unit 2, and the other face opposite to the mounting surface 3A serves as an installation surface installed to an application surface such as a ceiling or a wall. The base plate 3 has an installation mechanism counterpart 31 on the mounting surface 3A for engagement with the installation mechanism 21 of the light source unit 2. The installation mechanism counterpart 31 has an engagement portion counterpart 32 provided across one side extending along the longitudinal direction of the base plate 3 and engaged with the engagement portion 22 of the light source unit 2, and a holding portion counterpart 33 provided across the other side extending along the longitudinal direction of the base plate 3 and engaged with the holding portion 23 of the light source unit 2. The light source unit 2 is pivotable against the base plate 3 with respect to the engagement portion 22 while the engagement portion 22 is engaged with the engagement portion counterpart 32 of the base plate 3 (refer to FIG. 2).

The electric feeding portion 4 has an input connector 41 connected to an external power supply, a connector 42 for feeding the light source unit 2 with the electric power input to the input connector 41, and an end cap 43 that protects a feeding terminal (not shown) of the light source unit 2 positioned in a distal end of an electric circuit. The connector 42 is detachably installed in any one of a plurality of connector receptacles 34 provided on the mounting surface 3A of the base plate 3. By installing the connector 42 to any one of the connector receptacles 34, it is possible to arrange the light source unit 2 in a desired arrangement pattern against the base plate 3.

The hook mechanism 5 has a wire member 51 provided on the mounting surface 2A of the light source unit 2, and a hook member 52 provided on the mounting surface 3A of the base plate 3 and engaged with the wire member 51. The wire member 51 is engaged with the hook member 52 to catch the light source unit 2 and the base plate 3 when the installation mechanism 21 of the light source unit 2 and the installation mechanism counterpart 31 of the base plate 3 are not engaged with each other. The wire member 51 is housed in the concave portion 25 provided on the mounting surface 2A of the light source unit 2 so as to be contained within a thickness of the light source unit 2 when the light source unit 2 is mounted to the base plate 3 (refer to FIG. 2). A leading end of the hook member 52 is arranged to face the holding portion counterpart 33 of the base plate 3.

Figure 3:
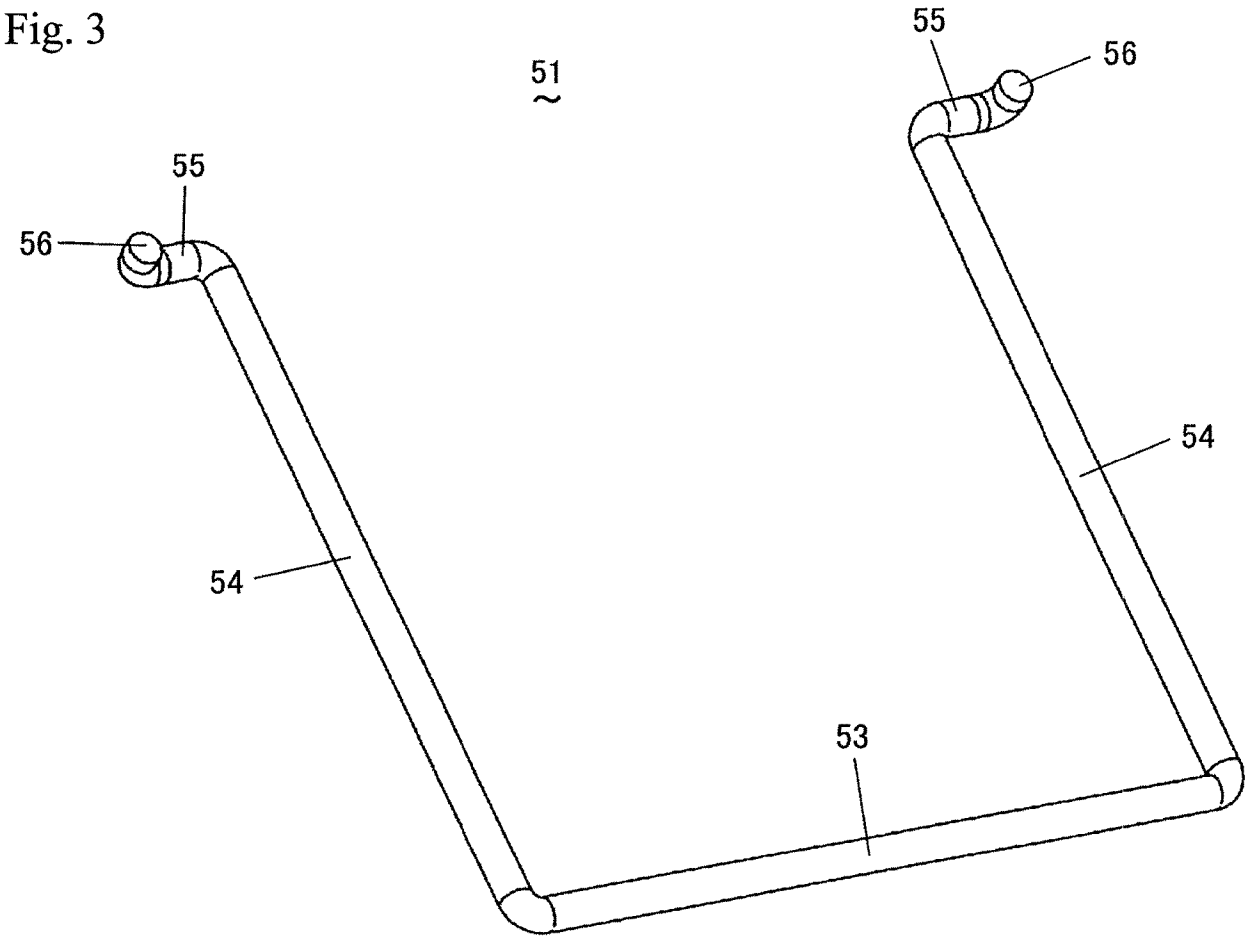
FIG. 3 is a perspective view illustrating a wire member of the light emitting module.

As illustrated in FIG. 3, the wire member 51 having an approximately U-shape includes a clasp portion (entangled portion) engaged with the hook member 52 extending in one direction, and a pair of extending portions 54 extending in the same direction perpendicularly to the clasp portion 53 from both ends of the clasp portion 53. In addition, the wire member 51 also has a pair of foot portions 55 extending outward from each end of a pair of extending portion 54 oppositely to each other in parallel to the clasp portion 53, and a pair of stoppers 56 extending from each end of the foot portion 55 perpendicularly to both the clasp portion 53 and the extending portions 54 in the same direction.

Figure 4:
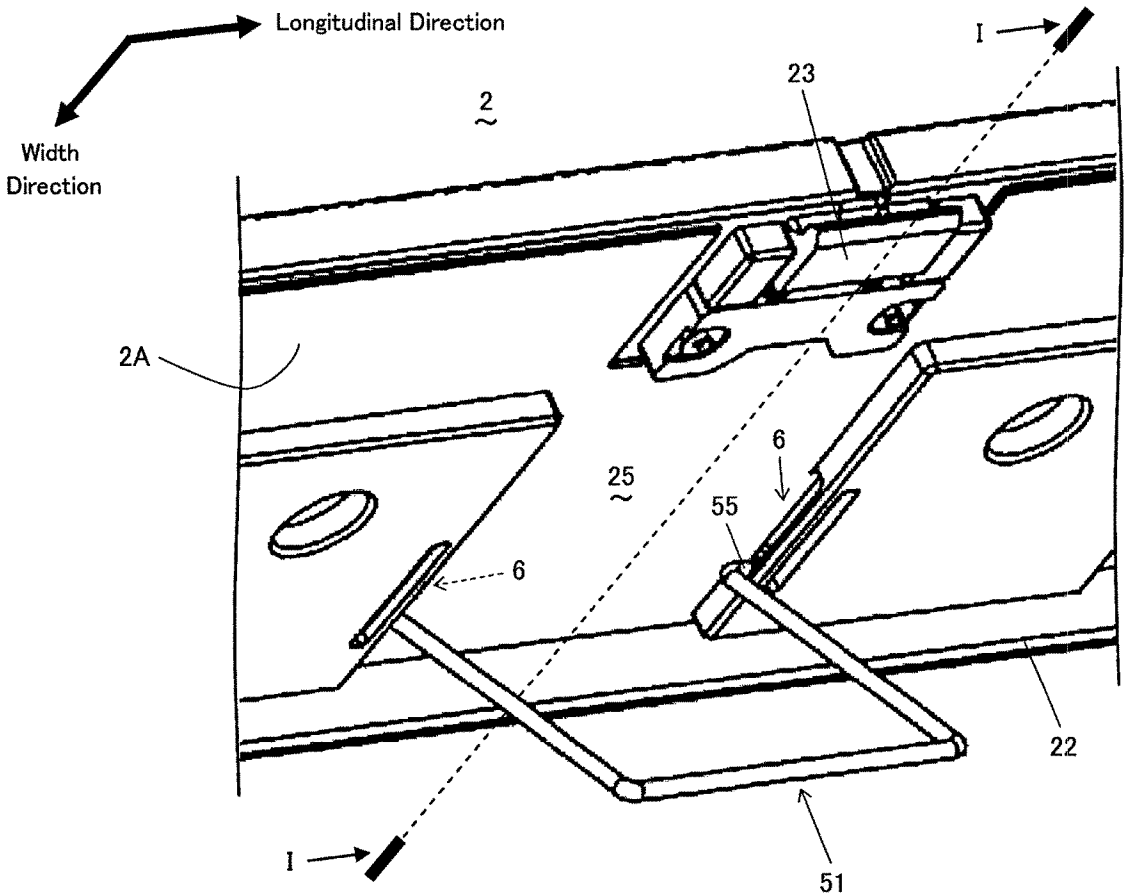
FIG. 4 is a perspective view illustrating a light source unit installed with the wire member.
Figure 5:
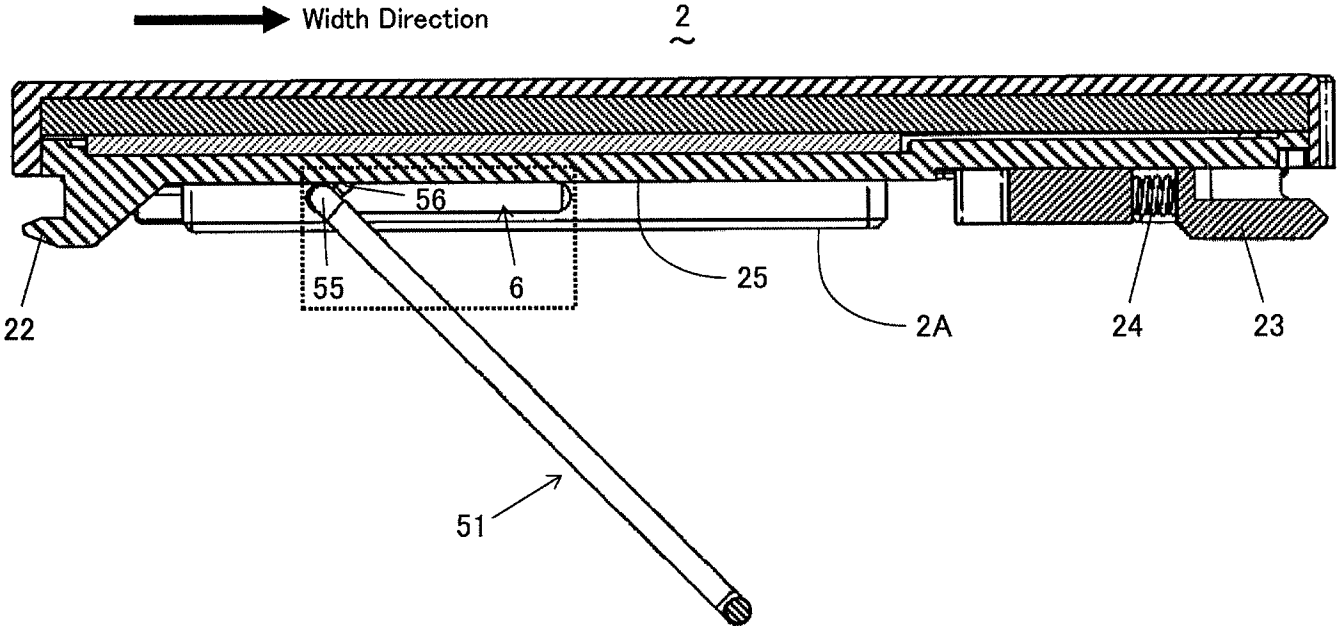
FIG. 5 is a cross-sectional view taken along a line I-I of FIG. 4.

As illustrated in FIGS. 4 and 5, the wire member 51 is held by the light source unit 2 while the foot portions 55 and the stoppers 56 are inserted into a pair of slide trenches 6 provided in side walls of the longitudinal direction of the concave portion 25. Each of the slide trenches 6 extending in the transverse direction are fog wed by carving in parallel to the mounting surface 2A to face each other. A pair of slide trenches 6 are arranged on the mounting surface 2A in the engagement portion 22 side.

As illustrated in FIG. 6A, the slide trench 6 has a slot 61 carved in parallel to the mounting surface 2A (indicated by dots), and a wall 62 that partially covers the side opposite to the mounting surface 2A side of the slot 61 such that the wire member 51 can slide against the slot 61 in the transverse direction. An area 63 of the slot 61 covered by the wall 62 is sized to house the stopper 56 of the wire member 51. As a result, the wire member 51 becomes slidable along the transverse direction while being inserted into the slide trench 6 and pivotable against the light source unit 2 with respect to the foot portion 55 matching the clasp portion 53.

As illustrated in FIG. 6B, when an angle between the extending portion 54 of the wire member 51 and the mounting surface 2A is at 90°, the stopper 56 of the wire member 51 abuts on an inner wall of the slide trench 6 so as to stop further pivoting of the wire member 51. In this manner, the stopper 56 restricts a pivoting range of the wire member 51.

When an angle between the extending portion 54 and the mounting surface 2A is at 90°, that is, in the position where the stopper 56 restricts pivoting of the wire member 51, the stopper 56 does not interfere with the wall 62. In this case, the wire member 51 becomes detachable to the slide trench 6. In this manner, since the wire member 51 can be detachable to the slide trench 6 only at a predetermined angle, it is possible to prevent the wire member 51 from dropping from the slide trench 6 unintentionally during the pivoting. It is noted that cross sections are not hatched in FIGS. 6A and 6B for simplicity purposes.

Figure 7A:
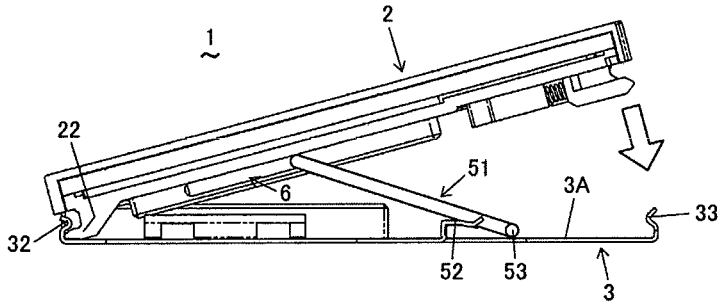
FIGS. 7A to 7D are side views illustrating operation of the light emitting module when the light source unit is mounted to the base plate.
Figure 7B:
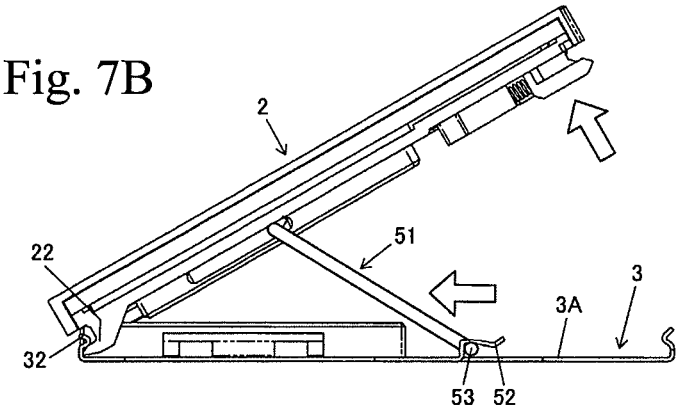
Figure 7C:
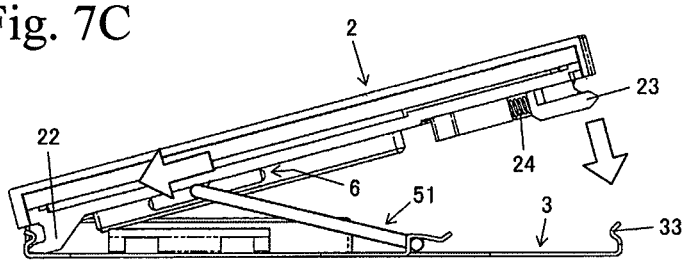
Figure 7D:
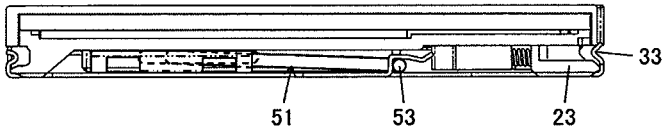

Next, a description will be made for operation of the light emitting module 1 when the light source unit 2 is mounted to the base plate 3 with reference to FIGS. 7A to 7D. First, as illustrated in FIG. 7A, the light source unit 2 is pivoted toward the base plate 3 while the engagement portion 22 of the light source unit 2 is engaged with the engagement portion counterpart 32 of the base plate 3, so that the clasp portion 53 of the wire member 51 is arranged on the mounting surface 3A between the hook member 52 and the holding portion counterpart 33. As the light source unit 2 is pivoted from this state oppositely to a direction where the light source unit 2 is mounted to the base plate 3 as illustrated in FIG. 7B, the clasp portion 53 of the wire member 51 slides on the mounting surface 3A toward the hook member 52 so as to be engaged with the hook member 52. As a result, the light source unit 2 is temporarily fixed to the base plate 3 so that the light source unit 2 does not drop from the base plate 3 in this state even when the engagement between the engagement portion 22 and the engagement portion counterpart 32 is released. Then, as the light source unit 2 is pivoted toward the base plate 3 again as illustrated in FIG. 7C, the wire member 51 slides toward the engagement portion 22 along the slide trench 6, so that the holding portion 23 of the light source unit 2 and the holding portion counterpart 33 of the base plate 3 approach each other to abut on each other. The holding portion 23 abutting on the holding portion counterpart 33 is pressed inward of the light source unit 2 resisting to an elastic force of the spring 24, so that it climbs over the holding portion counterpart 33 and is then engaged with the holding portion counterpart 33 as illustrated in FIG. 7D. In this manner, the light source unit 2 is mounted to the base plate 3, and the wire member 51 is engaged with the hook member 52.

Figure 8A:
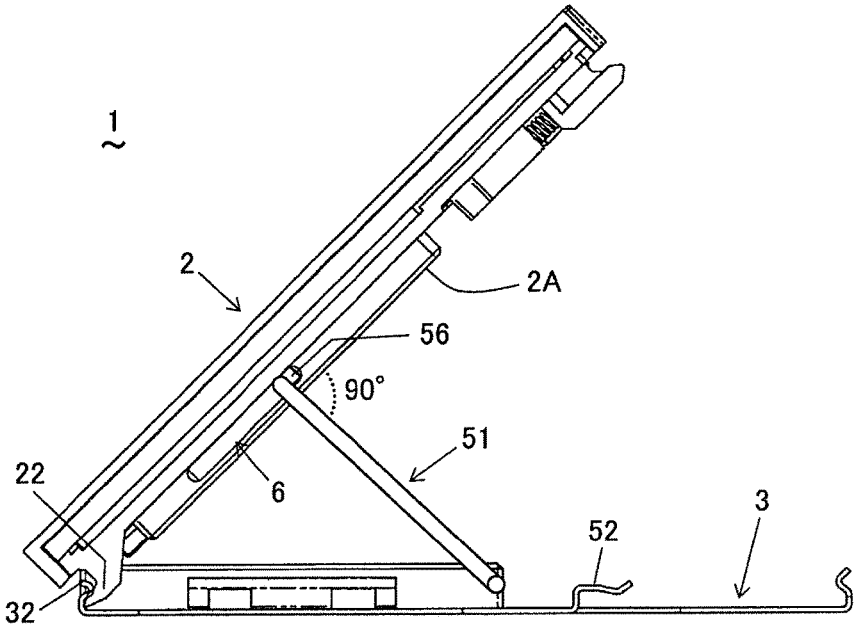
FIGS. 8A and 8B are side views illustrating operation of the light emitting module when a user manually engages the wire member with the hook member.
Figure 8B:
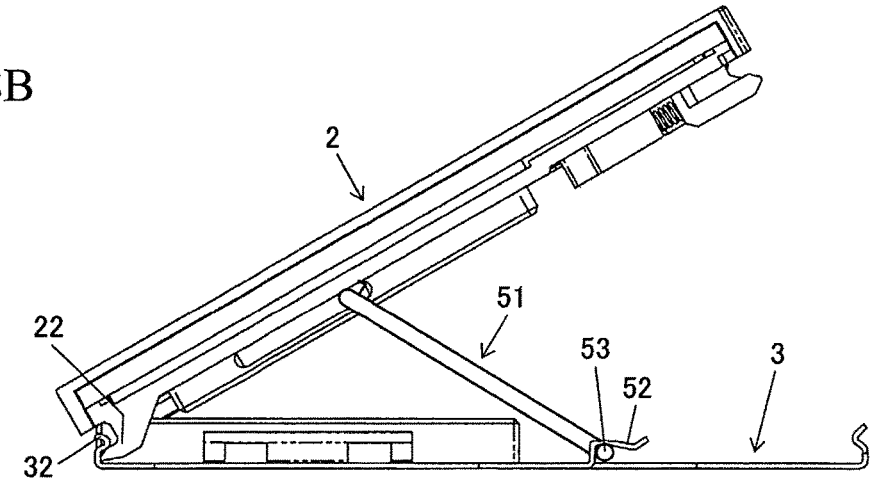

The engagement between the wire member 51 and the hook member 52 may be performed manually by a user. In this case, first, the engagement portion 22 of the light source unit 2 is engaged with the engagement portion counterpart 32 of the base plate 3 as illustrated in FIG. 8A. Here, since the wire member 51 abuts on the inner wall of the slide trench 6 and is not pivoted over 90° against the mounting surface 2A, the wire member 51 and the hook member 52 can be easily engaged with each other in the next stage. Then, as illustrated in FIG. 8B, the clasp portion 53 of the wire member 51 and the hook member 52 are engaged with each other manually by a user. Then, the light source unit 2 is mounted to the base plate 3 through the same operation as described above in relation to FIGS. 7C and 7D.

Next, a description will be made for operation of removing the light source unit 2 from the base plate 3 with reference to FIGS. 9A to 9D. It is noted that, in these drawings, the base plate 3 is illustrated in the upper side, and the light source unit 2 is illustrated in the lower side, in order to facilitate imagination of the operation of removing the light source unit 2 from the base plate 3 installed to an application surface such as a ceiling.

Figure 9A:
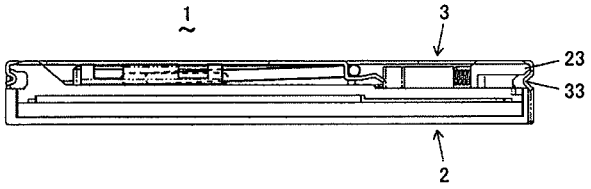
FIGS. 9A to 9D are side views illustrating operation of the light emitting module when the light source unit is removed from the base plate.
Figure 9B:
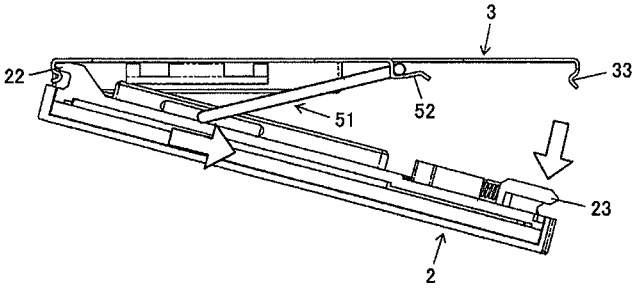
Figure 9C:
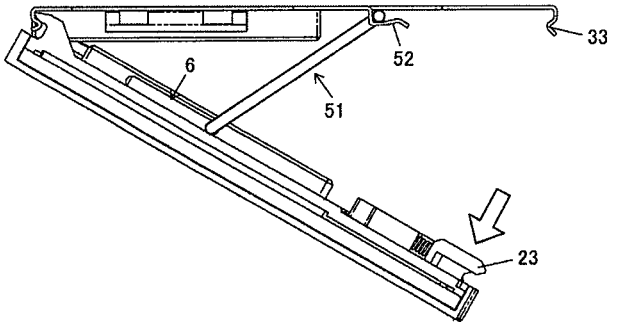
Figure 9D:
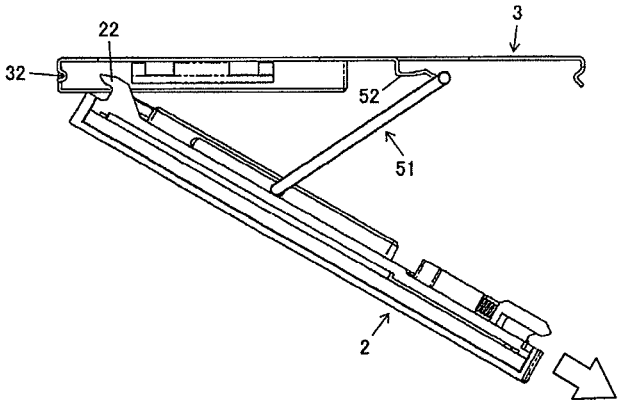

The operation illustrated in FIGS. 9A to 9C is performed reversely to the operation illustrated in FIGS. 8B to 8D. As illustrated in FIG. 9A, the light source unit 2 mounted to the base plate 3 is pulled so as to disengage the holding portion 23 of the light source unit 2 and the holding portion counterpart 33 of the base plate 3 from each other. Then, as illustrated in FIG. 9B, engagement between the holding portion 23 and the holding portion counterpart 33 is released, and the light source unit 2 is pivoted against the base plate 3 with respect to the engagement portion 22. At the same time, the wire member 51 slides along the slide trench 6 toward the holding portion 23 while being engaged with the hook member 52. In addition, as illustrated in FIG. 9C, as the wire member 51 arrives at an end of the holding portion 23 side of the slide trench 6, the wire member 51 catches the light source unit 2 and the base plate 3 while the holding portion 23 and the holding portion counterpart 33 are not engaged with each other. In this case, since the leading end of the hook member 52 are arranged to face the holding portion counterpart 33, the wire member 51 is not separated from the hook member 52, and it is possible to reliably prevent the light source unit 2 from dropping from the base plate 3 even when the light source unit 2 is pivoted against the base plate 3 with an excessive force. Then, as the light source unit 2 recedes from the base plate 3 as illustrated in FIG. 9D to separate the engagement portion 22 of the light source unit 2 from the engagement portion counterpart 32 of the base plate 3, the wire member 51 and the hook member 52 are also disengaged from each other. In this manner, since it is possible to simultaneously perform disengagement between the engagement portion 22 and the engagement portion counterpart 32 and disengagement between the wire member 51 and the hook member 52, it is possible to provide excellent operability.

As described above, in the light emitting module 1 according to this embodiment, the hook mechanism 5 catches the light source unit 2 and the base plate 3 even when a user disengages the installation mechanism 21 and the installation mechanism counterpart 31 from each other by pulling the light source unit 2 in order to remove the light source unit 2 from the base plate 3. As a result, it is possible to prevent the light source unit 2 from dropping from the base plate 3 and improve safety. In addition, since the hook mechanism 5 is contained within a thickness of the light source unit 2 when the light source unit 2 is mounted to the base plate 3, it is possible to prevent an increase of the thickness of the light source unit 2 and provide a fancy look of the light emitting module 1.

Next, a description will be made for a light emitting module according to a modification of the aforementioned embodiment with reference to FIGS. 10A to 10C. In the light emitting module 11, the leading end of the hook member 52 provided in the base plate 3 faces the engagement portion counterpart 32.

Figure 10A:
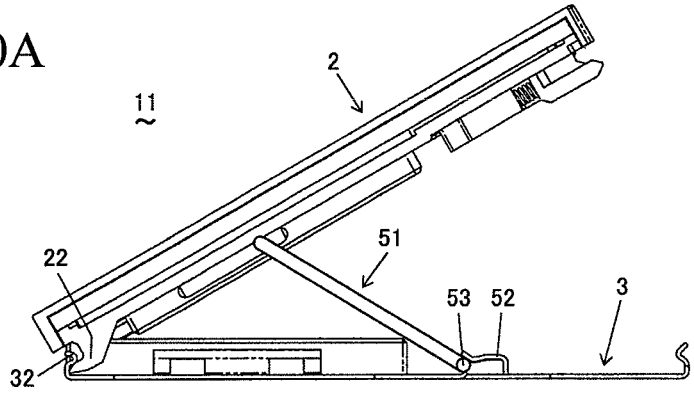
FIGS. 10A to 10C are side views illustrating operation of the light emitting module according to a modification of the aforementioned embodiment when the light source unit is mounted to the base plate.
Figure 10B:
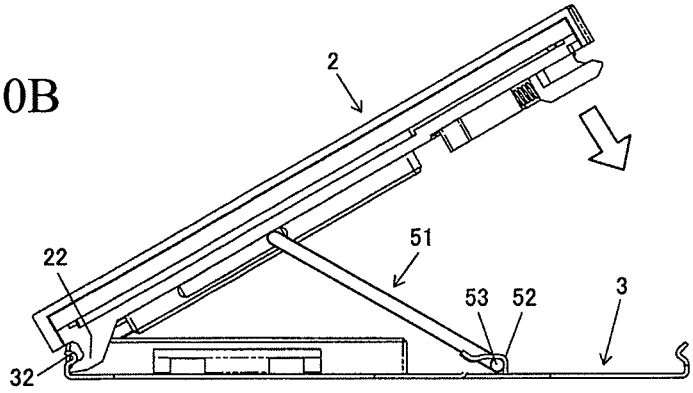
Figure 10C:
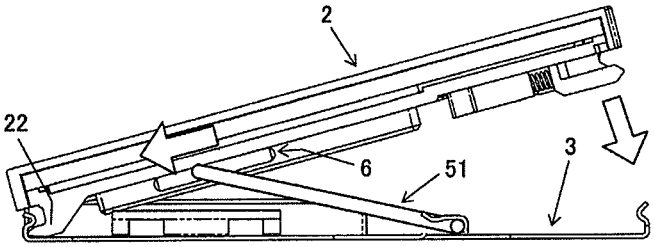

In the light emitting module 11, in order to mount the light source unit 2 to the base plate 3, first, the engagement portion 22 is engaged with the engagement portion counterpart 32 so as to cause the clasp portion 53 of the wire member 51 to abut on the leading end of the hook member 52 as illustrated in FIG. 10A. In this state, as the light source unit 2 is pivoted toward the base plate 3 as illustrated in FIG. 10B, the clasp portion 53 of the wire member 51 is pressed toward the hook member 52 and is engaged with the hook member 52. Then, as the light source unit 2 is further pivoted toward the base plate 3 as illustrated in FIG. 10C, the wire member 51 slides along the slide trench 6 toward the engagement portion 22 side, so that the light source unit 2 is mounted to the base plate 3. It is noted that the light source unit 2 may be removed from the base plate 3 in the order reversed to that of the operation of FIGS. 10A to 10C described above.

Figure 11:
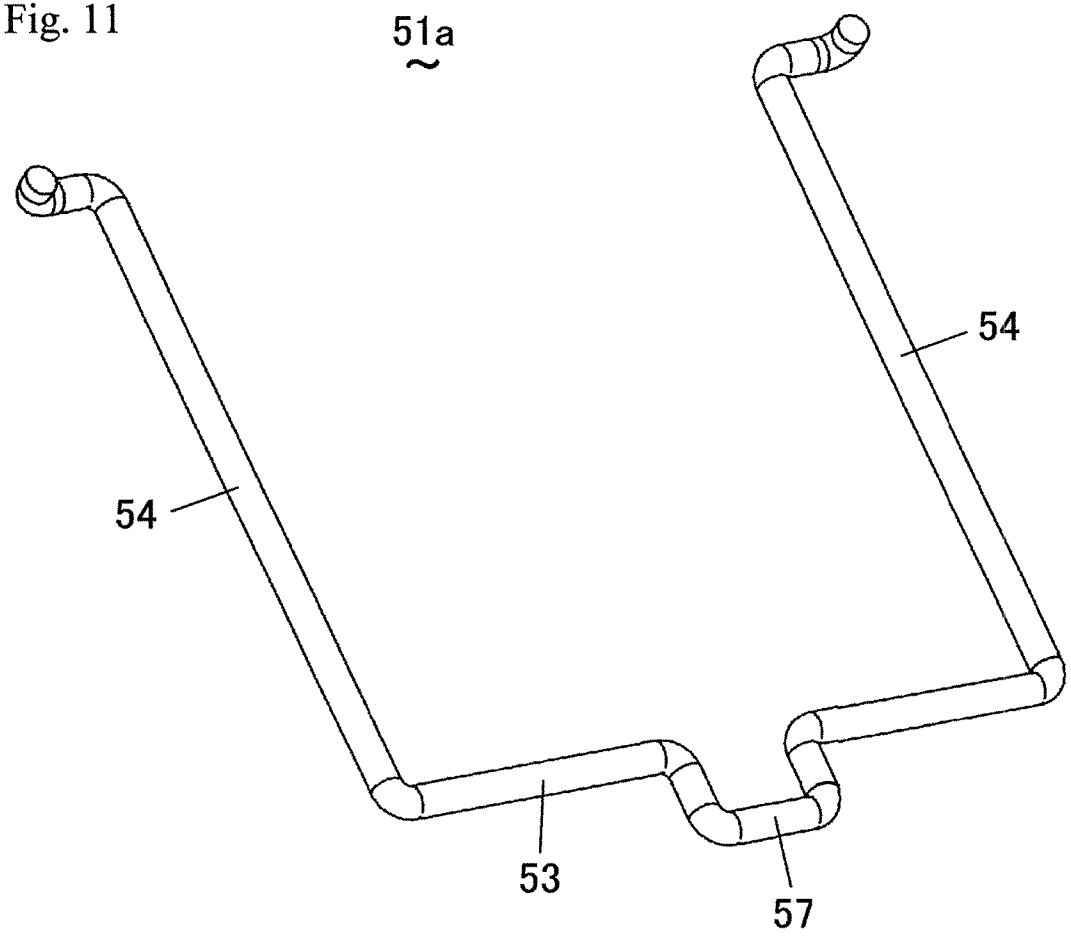
FIG. 11 is a perspective view illustrating the wire member of the light emitting module according to another modification of the aforementioned embodiment.

Next, a description will be made for a wire member of a light emitting module according to another modification of the aforementioned embodiment with reference to FIG. 11. The the clasp portion 53 of the wire member 51*a* is further provided with a curved portion 57 fitted to the hook member 52 in addition to the wire member 51 described above. The curved portion 57 protrudes from the center of the clasp portion 53 reversely to an extending direction of the extending portion 54 by the width of the hook member 52.

By providing the curved portion 57 in this manner, it is possible to make it easy to recognize the engagement position between the wire member 51*a* and the hook member 52 and thus improve operability. In addition, by positioning the curved portion 57 and the hook member 52 to match each other when the light source unit 2 is mounted to the base plate 3, it is possible to restrict the position of the light source unit 2 in the longitudinal direction of the base plate 3 and arrange the light source unit 2 against base plate 3 in a predetermined position with high accuracy.

Figure 12A:
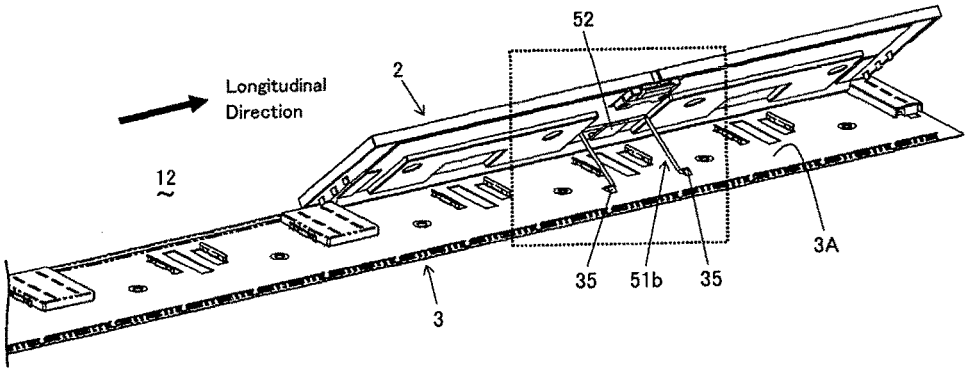
FIG. 12A is a perspective view illustrating a light emitting module according to another embodiment of the present invention.
Figure 12B:
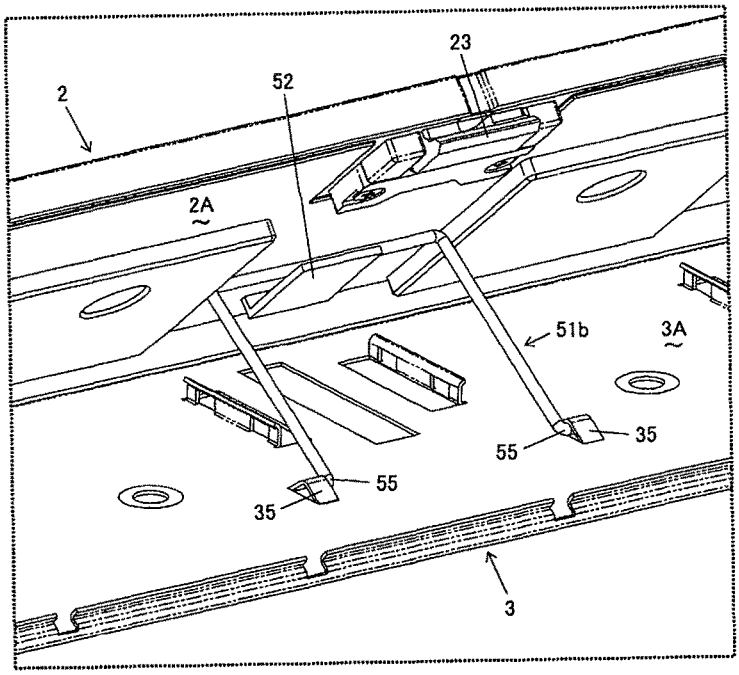
FIG. 12B is an enlarged view illustrating a part enveloped by the dotted line of FIG. 12A.

Next, a description will be made for a light emitting module according to another embodiment of the present invention with reference to FIGS. 12 and 13. As illustrated in FIGS. 12A and 12B, in the light emitting module 12, a wire member 51*b* is provided in the base plate 3, and a hook member 52 is provided in the light source unit 2. The wire member 51*b* is similar to the wire member 51 excluding the stopper 56. In the wire member 51*b*, the foot portion 55 is pivotably held against the base plate 3 while it is rotatably supported by a pair of wire member supports 35 provided on the mounting surface 3A of the base plate 3 along the longitudinal direction. The hook member 52 is provided on the mounting surface 2A of the light source unit 2 such that its leading end faces the holding portion 23.

Figure 13A:
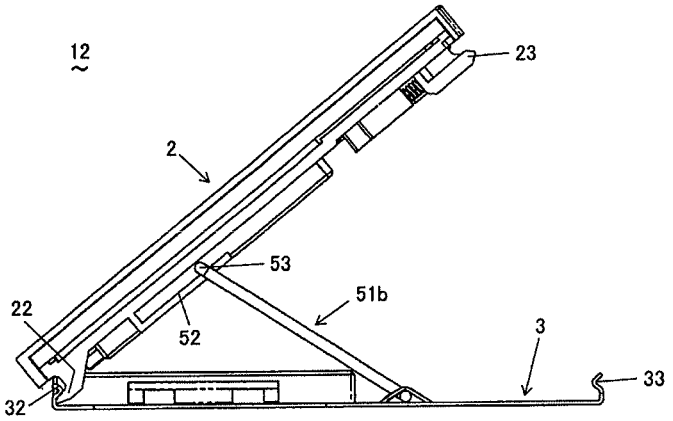
FIGS. 13A to 13D are side views illustrating operation of the light emitting module when the light source unit is mounted to the base plate.
Figure 13B:
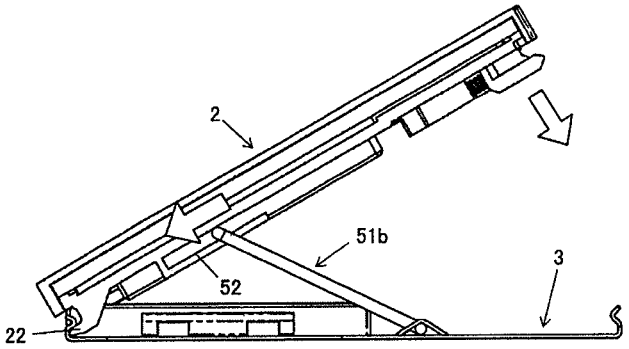
Figure 13C:
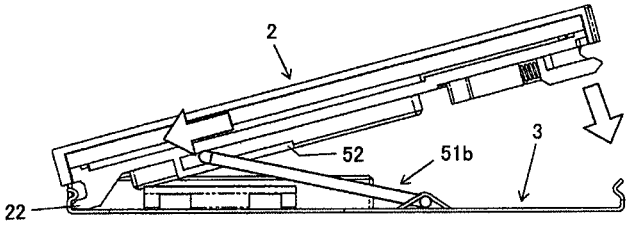
Figure 13D:
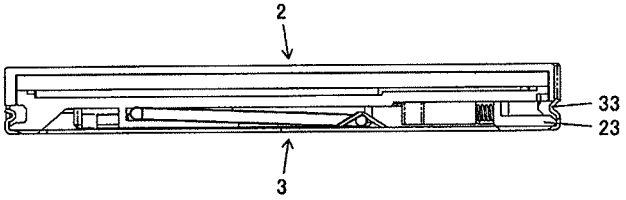

As illustrated in FIGS. 13A to 13D, in the light emitting module 12, in order to mount the light source unit 2 to the base plate 3, first, the clasp portion 53 of the wire member 51*b* is engaged with the hook member 52 while the engagement portion 22 and the engagement portion counterpart 32 are engaged with each other as illustrated in FIG. 13A. Then, as the light source unit 2 is pivoted toward the base plate 3 as illustrated in FIG. 13B and 13C, the wire member 51*b* slides on the hook member 52 toward the engagement portion 22 side, so that the light source unit 2 is mounted to the base plate 3 as illustrated in FIG. 13D. It is noted that the light source unit 2 may be removed from the base plate 3 in the order reversed to that of the operation of FIGS. 13A to 13D.

In the light emitting module 12 described above, the light source unit 2 more frequently replaced compared to the base plate 3 is provided with the hook member 52 having a simple structure, and the base plate 3 less frequently replaced is provided with the wire member 51*b* having a more complicated structure than that of the hook member 52. For this reason, it is possible to manufacture the light source unit 2 more easily and more inexpensively.

Figure 14A:
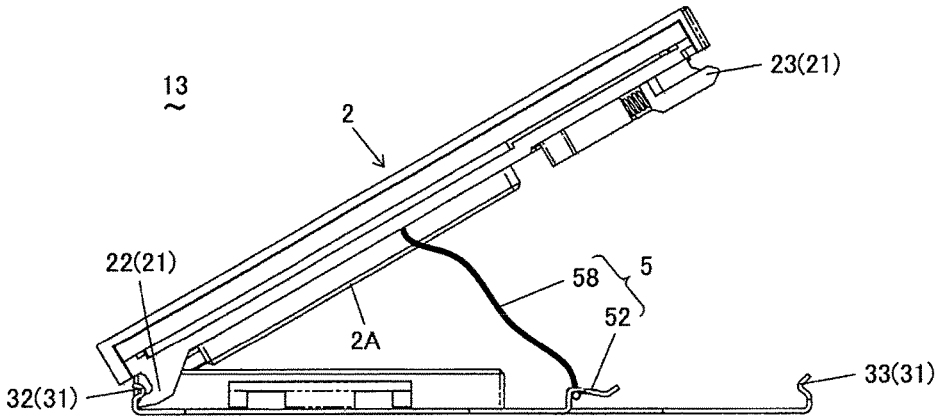
FIGS. 14A and 14B are side views illustrating a light emitting module according to still another embodiment of the present invention.

Next, a description will be made for a light emitting module according to still another embodiment of the present invention with reference to FIGS. 14A and 14B. As illustrated in FIG. 14A, in the light emitting module 13, the hook member 5 has an elastic member 58 installed on the mounting surface 2A of the light source unit 2 and a hook member 52 provided in the base plate 3 and engaged with the elastic member 58. The elastic member 58 is formed of, for example, a rubber string. By entangling the leading end of the rubber string to the hook member 52, it is possible to prevent the light source unit 2 from dropping from the base plate 3 even when the installation mechanism 21 of the light source unit 2 and the installation mechanism counterpart 31 of the base plate 3 are not engaged with each other.

Figure 14B:
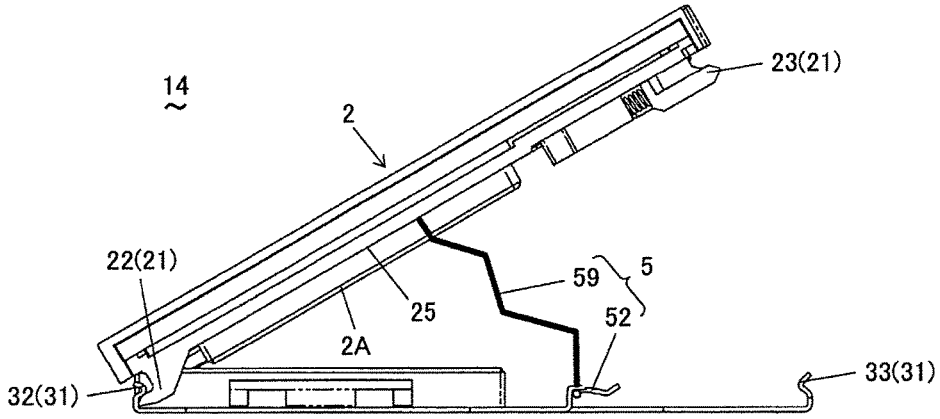

As illustrated in FIG. 14B, in the light emitting module 14, the hook mechanism 5 has a foldable member 59 provided on the mounting surface 2A of the light source unit 2 and configured foldably, and a hook member 52 provided in the base plate 3 and engaged with the foldable member 59. The foldable member 59 is configured, for example, by linking a plurality of stick-like members such that their linking portions can be bent. The foldable member 59 is folded so as to be housed in the concave portion 25 of the light source unit 2 when the light source unit 2 is mounted on the base plate 3. Similar to the light emitting module 13, using the light emitting module 14, it is possible to prevent the light source unit 2 from dropping from the base plate 3 even when the installation mechanism 21 of the light source unit 2 and the installation mechanism counterpart 31 of the base plate 3 are not engaged with each other.

Figure 15:
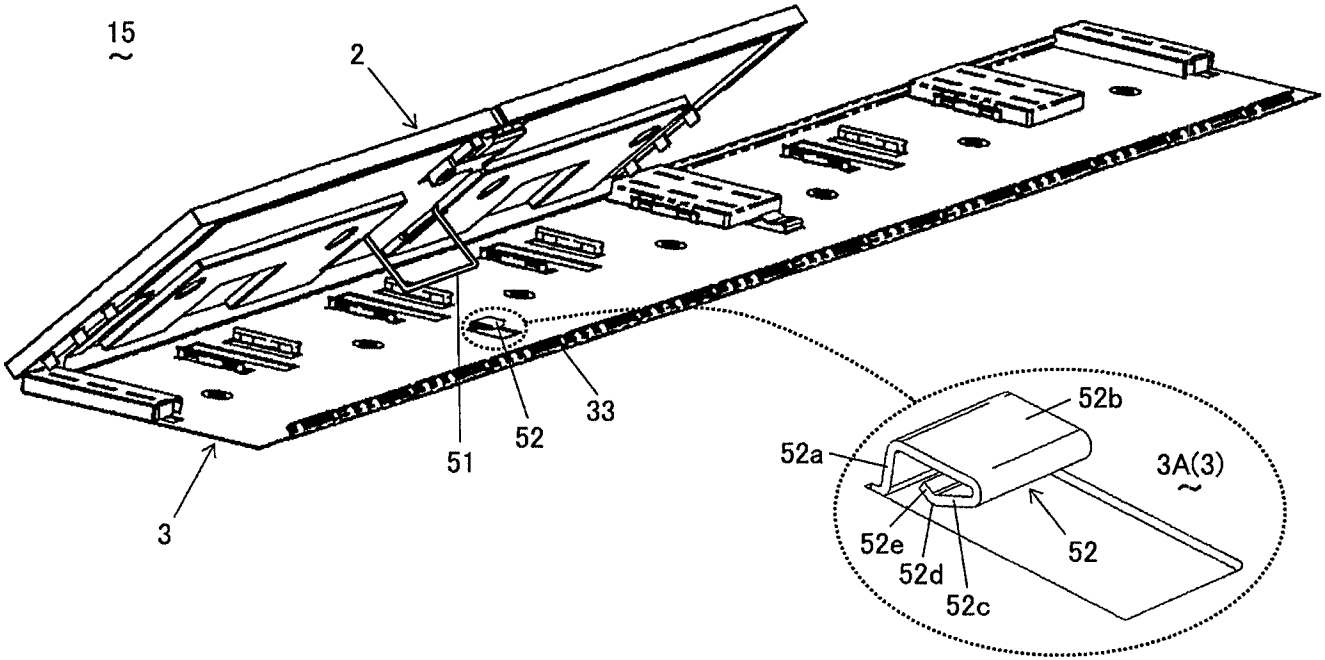
FIG. 15 is a perspective view illustrating a light emitting module according to still further another embodiment of the present invention, a part of which being partially enlarged.

Next, a description will be made for a light emitting module according to still further another embodiment of the present invention with reference to FIGS. 15 and 16. As illustrated in FIG. 15, the light emitting module 15 is similar to the light emitting module 1 except for a configuration of the hook member 52.

The hook member 52 has an erected piece 52*a* erected from the mounting surface 3A of the base plate 3, a paralleled piece 52*b* extending from an end of the erected piece 52*a* in parallel to the mounting surface 3A, and a folded piece 52*c* extending from an end of the paralleled piece 52*b* toward a basal portion of the erected piece 52*a*. In addition, the hook member 52 has a locking piece 52*e* extending from an end 52*d* of the folded piece 52*c* toward a connecting portion between the erected piece 52*a* and the paralleled piece 52*b* to lock the wire member 51. The hook member 52 is formed of an elastic material such as a plate spring and is arranged such that the connecting portion between the paralleled piece 52*b* and the folded piece 52*c* faces the holding portion counterpart 33 of the base plate 3. It is noted that the hook member 52 may be configured without the locking piece 52*e*.

Figure 16A:
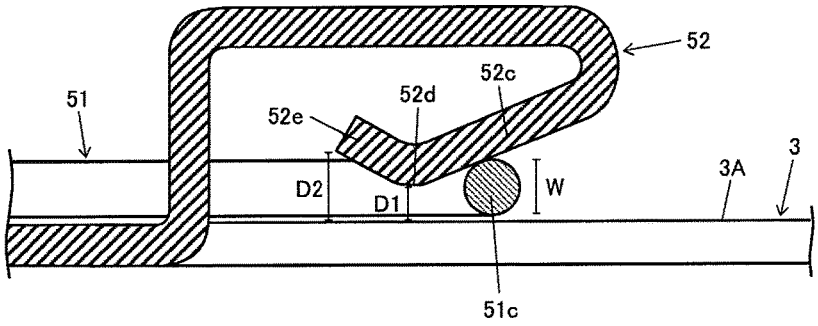
FIGS. 16A to 16C are side cross-sectional views illustrating operation of the light emitting module when the wire member is engaged with the hook member.

As illustrated in FIG. 16A, a gap D1 between the end 52*d* 6 of the folded piece 52*c* and the mounting surface 3A of the base plate 3 is smaller than a cross-sectional width W of an entangled portion 516*c* of the wire member 51 entangled with the hook member 52. In addition, a gap D2 between an end of the locking piece 52*e* and the mounting surface 3A is larger than a cross-sectional width W of the entangled portion 51*c*.

Figure 16B:
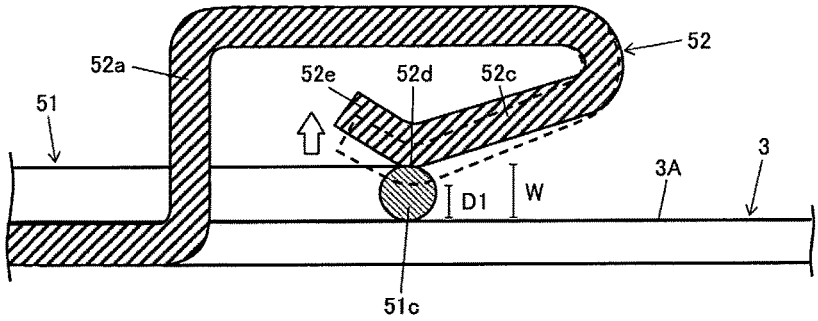

A description will be made for operation of engaging the wire member 51 with the hook member 52 with reference to FIGS. 16B and 16C in addition to FIG. 16A described above. First, as illustrated in FIG. 16A, the entangled portion 51*c* of the wire member 51 is made to abut on the folded piece 52*c* of the hook member 52. Then, as illustrated in FIG. 16B, the wire member 51 is moved toward the erected piece 52*a*. As a result, since the gap D1 is smaller than the cross-sectional width W of the entangled portion 51*c*, the wire member 51 passes through a gap between the end 52*d* and the mounting surface 3A while it elastically defog ms the hook member 52 and widens the gap D1 to be larger than the cross-sectional width W. Then, as illustrated in FIG. 16C, since the gap D2 is larger than the cross-sectional width W of the entangled portion 51*c*, the wire member 51 passes through a gap between the end of the locking piece 52*e* and the mounting surface 3A and is engaged with the hook member 52.

Figure 16C:
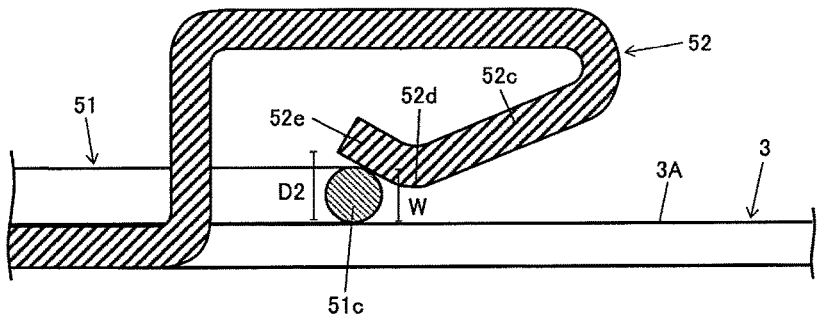

Meanwhile, the wire member 51 is removed from the hook member 52 in the order reversed to that of the process of FIGS. 16A to 16C. That is, the wire member 51 is moved toward the folded piece 52*c* as illustrated in FIG. 16C from the state that the entangled portion 51*c* of the wire member 51 abuts on the locking piece 52*e*. In this case, since the gap D2 is larger than the cross-sectional width W of the entangled portion 51*c*, it is possible to rapidly move the wire member 51 by guiding the locking piece 52*e*. Then, as illustrated in FIG. 16B, the wire member 51 passes through the gap between the end 52*d* and the mounting surface 3A resisting to an elastic force of the hook member 52. As a result, the wire member 51 is removed from the hook member 52 as illustrated in FIG. 16A. In this manner, in order to remove the wire member 51 from the hook member 52, it is necessary to flex the hook member 52 resisting to the elastic force. Therefore, it is possible to make it difficult to release the wire member 51 from the hook member 52 and reliably prevent the light source unit 2 from dropping from the base plate 3.

It is noted that the light emitting module according to the present invention and the illuminating device using the same may be changed or modified in various manners without limiting the aforementioned embodiments and modifications thereof. For example, on the basis of the aforementioned light emitting module 12, the wire member may slide on the mounting surface of the base plate instead of sliding in the light source unit. Alternatively, a plurality of wire members may be provided in each of the light source unit.

REFERENCE SIGNS AND NUMERALS 1, 11, 12, 13, 14, 15light emitting module
2 light source unit
21 installation mechanism
22 engagement portion
23 holding portion
25 concave portion
3 base plate
3A mounting surface (of base plate)
31 installation mechanism counterpart
32 engagement portion counterpart
33 holding portion counterpart
4 electric feeding portion
5 hook mechanism
51, 51*a*, 51*b* wire member
51*c* entangled portion of wire member entangled with hook member
52 hook member
52*a* erected piece
52*b* paralleled piece
52*c* folded piece
52*d* end of folded piece
52*e* locking piece
56 stopper
57 curved portion
58 elastic member
59 foldable member
D1 gap between end of folded piece and mounting surface (of base plate)
D2 gap between end of locking piece and mounting surface (of base plate)

W cross-sectional width of wire member in entangled portion entangled with hook member

The invention claimed is:

1. A light emitting module comprising:

a flat light source; and a flat base plate having an electric feeding portion for feeding the light source with electric power, the light source having one surface as a luminescent face, an other surface of the light source, opposite to the luminescent face, having an installation mechanism for detachably installing the light source to the base plate, the base plate having a counterpart installation mechanism engaged with the installation mechanism on a mounting surface where the light source is mounted, a hook mechanism that catches the light source and the base plate when the installation mechanism and the counterpart installation mechanism are not engaged with each other, the hook mechanism being contained within a thickness of the light source when the light source is mounted to the base plate, the installation mechanism is provided in both ends of the light source and has a holding portion and an engagement portion used in engagement with the counterpart installation mechanism, the holding portion is elastically biased in a direction away from the engagement portion, the counterpart installation mechanism has a counterpart engagement portion and a counterpart holding portion engaged with the engagement portion and the holding portion, respectively.

2. The light emitting module according to claim 1, wherein the hook mechanism has a wire member provided in any one of the light source and the base plate, and a hook member provided in the other one of the light source and the base plate, and is engaged with the wire member, and the wire member is pivotable against the light source or the base plate with respect to a portion matching an entangled portion entangled with the hook member.

3. The light emitting module according to claim 2, wherein the wire member is slidable against the light source or the base plate.

4. The light emitting module according to claim 2, wherein the light source has a concave portion that houses the wire member when the light source is mounted to the base plate.

5. The light emitting module according to claim 2, wherein the hook mechanism has a wire member provided in the light source, and a hook member provided in the base plate and engaged with the wire member, the wire member is pivotable against the light source with respect to a portion matching an entangled portion entangled with the hook member, the light source is pivotable toward the base plate while the engagement portion is engaged with the counterpart engagement portion of the base plate, and the wire member is engaged with the hook member when the light source is pivoted against the base plate.

6. The light emitting module according to claim 5, wherein the wire member is separated from the hook member as the light source recedes from the base plate to separate the engagement portion from the counterpart engagement portion while the light source is pivoted against the base plate.

7. The light emitting module according to claim 5, wherein the hook member is arranged such that a leading end of the hook member faces the counterpart holding portion.

8. The light emitting module according to claim 7, wherein the hook member is engaged with the wire member when the light source is pivoted reversely to a direction of mounting the light source to the base plate.

9. The light emitting module according to claim 2, wherein the wire member has a curved portion where the hook member is fitted.

10. The light emitting module according to claim 2, wherein the wire member has a stopper for restricting a pivoting range of the wire member.

11. The light emitting module according to claim 10, wherein the wire member is detachably installed to the light source or the base plate in a position where pivoting is restricted by the stopper.

12. The light emitting module according to claim 2, wherein the hook mechanism has a wire member provided in the light source, and a hook member provided in the base plate and engaged with the wire member, the wire member is pivotable against the light source with respect to a portion matching an entangled portion entangled with the hook member, the hook member has a projecting piece that projects from the mounting surface of the base plate, a parallel piece extending from an end of the projecting piece in parallel to the mounting surface, and a folded piece extending from an end of the parallel piece toward a base portion of the projecting piece.

13. The light emitting module according to claim 12, wherein a gap between an end of the folded piece and the mounting surface is smaller than a cross-sectional width of the wire member in an entangled portion entangled with the hook member, and widens to be larger than the cross-sectional width as the hook member is elastically deformed.

14. The light emitting module according to claim 12, wherein the hook member further has a locking piece extending from an end of the folded piece toward a connecting portion between the projecting piece and the parallel piece to lock the wire member, and a gap between an end of the locking piece and the mounting surface is larger than a cross-sectional width of the wire member in an entangled portion entangled with the hook member.

15. The light emitting module according to claim 1, wherein the hook mechanism has an elastic member provided in any one of the light source and the base plate and a hook member provided in the other one of the light source and the base plate, and is engaged with the elastic member.

16. The light emitting module according to claim 1, wherein the hook mechanism has a foldable member provided in any one of the light source and the base plate and is configured to fold, and a hook member provided in the other one of the light source and the base plate, and is engaged with the foldable member.

17. An illuminating device comprising the light emitting module according claim 1.

18. The light emitting module according to claim 1, wherein the direction in which the holding portion is biased extends in a plane parallel to a plane of the flat base plate.

19. The light emitting module according to claim 1, the flat base plate having a generally rectilinear shape, the holding portion and the engagement portion of the installation mechanism being provided at opposite ends of the base plate in a direction transverse to a longitudinal direction of the base plate.

20. The light emitting module according to claim 1, the holding portion being linearly biased in the direction away from the engagement portion.

* * * * *